US010115537B2

(12) United States Patent
Pogorzelski et al.

(10) Patent No.: US 10,115,537 B2
(45) Date of Patent: Oct. 30, 2018

(54) APPARATUS FOR DETECTING A SWITCH POSITION

(71) Applicant: Robert Bosch GmbH, Stuttgart (DE)

(72) Inventors: Kamil Pogorzelski, Stuttgart (DE); Jacek Wiszniewski, Leinfelden-Echterdingen (DE); Zoltan Cer, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 135 days.

(21) Appl. No.: 14/743,056

(22) Filed: Jun. 18, 2015

(65) Prior Publication Data

US 2015/0369866 A1 Dec. 24, 2015

(30) Foreign Application Priority Data

Jun. 18, 2014 (DE) ..... 10 2014 211 647

(51) Int. Cl.
*H01H 9/16* (2006.01)

(52) U.S. Cl.
CPC ..... *H01H 9/167* (2013.01)

(58) Field of Classification Search
CPC .... H01H 9/167; H01H 47/325; B60L 3/0069; B60L 3/04; B62D 5/0481; G01R 31/3278; H02M 1/32; H02M 2001/0006; H02M 2001/0058; H02P 27/04; H02P 27/06; H02P 21/00; H02H 9/046
See application file for complete search history.

(56) References Cited

U.S. PATENT DOCUMENTS 5,153,489 A * 10/1992 Unsworth ..... H02P 27/02 318/490
2009/0256534 A1* 10/2009 Videtich ..... H02M 3/156 323/235
2011/0058296 A1* 3/2011 Orchowski ..... H05B 39/044 361/88
2011/0254489 A1* 10/2011 Greetham ..... H02P 6/14 318/400.14
2014/0361779 A1* 12/2014 Wiszniewski ..... G01R 31/3278 324/415

FOREIGN PATENT DOCUMENTS

CN 102985794 A 3/2013
DE 10 2006 033 705 1/2008
DE 10 2011 088 411 6/2013
DE 102011088411 A1 * 6/2013 ..... G01R 31/327

* cited by examiner

*Primary Examiner* — Son Le
*Assistant Examiner* — Akm Zakaria
(74) *Attorney, Agent, or Firm* — Maginot, Moore & Beck LLP

(57) ABSTRACT

An apparatus for detecting a switch position includes a first circuit node and a second circuit node configured to connect the apparatus to an AC electric voltage. The apparatus further includes a switch connected between the first circuit node and a third circuit node, and a resistor connected between the first circuit node and the third circuit node. The apparatus also includes a microcomputer device, and a switched-mode power supply apparatus connected between the second circuit node and the third circuit node. The switched-mode power supply apparatus is configured to provide a supply voltage to the microcomputer device at the third circuit node. The microcomputer device is configured to calculate a position of the switch from an electric detection voltage dropped between the third circuit node and the second circuit node.

8 Claims, 4 Drawing Sheets

APPARATUS FOR DETECTING A SWITCH POSITION

This application claims priority under 35 U.S.C. § 119 to patent application no. DE 10 2014 211 647.3, filed on Jun. 18, 2014 in Germany, the disclosure of which is incorporated herein by reference in its entirety.

The disclosure relates to an apparatus for detecting a switch position. The disclosure also relates to a method for detecting a switch position.

BACKGROUND

Electrical devices (for example electrical tools) often have switches in order to manually switch the devices on and off. Here, it is known to detect a position of said switches, for which purpose particular electrical and electronic components are used.

By way of example, it is important to detect the switch position because, in the event that a mains plug of the device is plugged into a socket when the switch is switched on, the electrical device may not start up or turn on. This operating procedure is known as "restart protection" and is partially defined in standards. Even in the event of temporary voltage drops during operation, the device may not subsequently be turned on again in an undefined manner. If the switch is open, a controlling semiconductor in principle may not be triggered.

Depending on the hazardousness of the device, it may also be required that redundant switch detection is to be provided by means of which an increased level of safety of the device is supported.

DE 10 2011 088 411 A discloses a circuit arrangement and a method for detecting a switch position. In that case, a microcontroller is programmed to compare a voltage present at a connection to a reference voltage and, on the basis of said comparison, to determine whether the switch is open or closed. What is disadvantageous in that case is that a specific type of microcontroller with an internal voltage reference or a microcontroller with an external voltage reference is necessary.

SUMMARY

A problem addressed by the present disclosure is to provide improved switch detection for a switch of an electrical device.

According to a first aspect, the problem is solved by means of an apparatus for detecting a switch position, having:

- a first circuit node and a second circuit node for connecting the apparatus to an AC electric voltage;
- a switch connected between the first circuit node and a third circuit node;
- a resistor connected between the first circuit node and the third circuit node; and
- a microcomputer device;
- a switched-mode power supply apparatus connected between the second circuit node and the third circuit node, by means of which switched-mode power supply apparatus a supply voltage can be provided for the microcomputer device at the third circuit node; characterized in that a position of the switch can be calculated by means of the microcomputer device from an electric voltage dropping between the third circuit node and the second circuit node.

According to a second aspect, the problem is solved by means of a method for detecting a switch position, having the steps of:

- providing an electric supply voltage at a first circuit node and a second circuit node, wherein the voltage can be switched on and off by means of a switch, wherein the switch is bridged by a resistor;
- providing a supply voltage by means of a switched-mode power supply device for a microcomputer device; and
- evaluating an electric voltage between a second circuit node of a voltage supply and a voltage supply of a microcomputer device, wherein the position of the switch is concluded from the analysis.

The microcomputer device is then also supplied with electric voltage when the switch is switched off. According to the disclosure, a so-called "detection voltage" is evaluated, which detection voltage represents a variable mains voltage on the basis of the switch position. Advantageously, said detection voltage can be evaluated by the microcomputer device with low technical complexity and hence the position of the switch can be calculated.

Advantageous developments of the apparatus and of the method are the subject matter of dependent claims.

An advantageous development of the apparatus is characterized in that a period of the detection voltage which is calculated by the microcomputer device is used to detect the switch position. In this case, the fact that a reference potential for the microcomputer device changes owing to the actuation of the switch is used. This has an influence on a synchronization signal which digitizes the frequency of the supplying AC voltage. In this way, it is possible to calculate by means of the microcomputer device when a start or an end of each half-cycle is present. Advantageously, the amplitude of the mains voltage has no influence on the detection of the switch position, as a result of which this variant is thus advantageously independent of an amplitude of the voltage level of the supply voltage.

Another advantageous development of the apparatus is characterized in that two resistors are connected in series between the third circuit node and the second circuit node, wherein a signal at a circuit node between the resistors is supplied to the microcomputer device, wherein the switch position is calculated from the level of the signal. This variant is particularly advantageous in the case of distorted voltage signals because only the amplitude of the signal is relevant and various zero crossings do not have any influence.

An advantageous development of the apparatus is characterized in that the level of the signal at the circuit node is sampled in each case in the middle of the half-cycle of the detection voltage and compared to a voltage reference value. In this way, a defined sampling instant is selected which enables a reliable evaluation of the detection voltage.

Another advantageous development of the apparatus is characterized in that a change in direction of the level of the detection voltage is evaluated in order to detect the position of the switch. In this way, advantageously, no absolute values of the detection voltage are used.

Another advantageous development of the apparatus is characterized in that both a voltage acquisition and a frequency acquisition of the detection voltage are used to detect the position of the switch. In this way, a redundant "two-channel" solution for switch detection is advantageously provided. As a result of this, the detection accuracy and operational safety of the electrical machine can be advantageously maximized.

The disclosure is described in detail below with further features and advantages with reference to several figures. In this case, all features form the subject matter of the disclosure independently of their depiction in the description and in the figures and independently of their back-reference in the patent claims. In particular, the figures are conceived to clarify the principles which are essential to the disclosure and must not in any circumstance be realized as detailed circuit diagrams.

BRIEF DESCRIPTION OF THE DRAWINGS

In the figures,

FIG. 3 shows a temporal signal profile of a voltage, which is evaluated in order to detect the switch position, when the switch is switched on;

DETAILED DESCRIPTION

Figure 1:
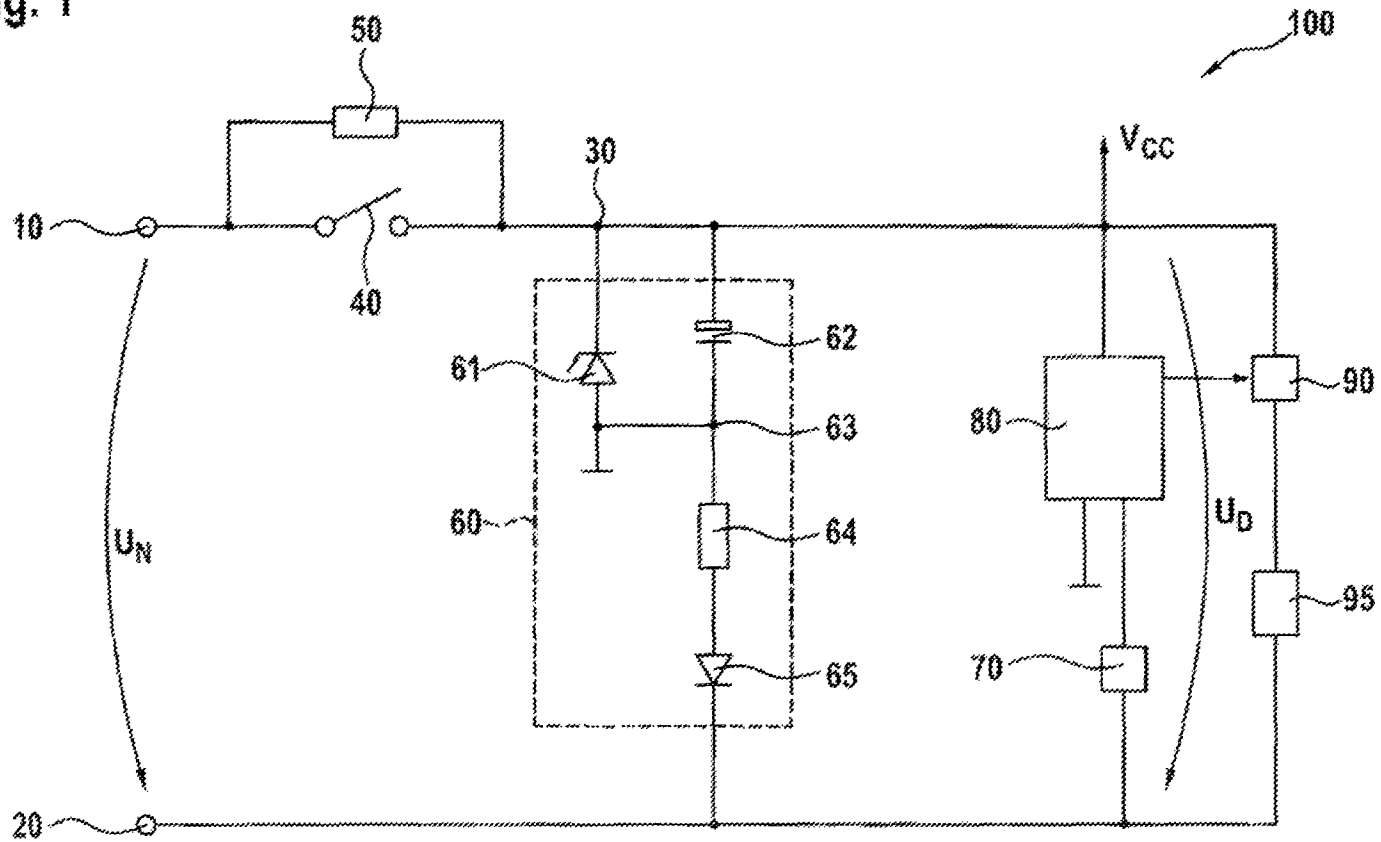
FIG. 1 shows a first embodiment of the apparatus according to the disclosure.

FIG. 1 shows a first embodiment of an apparatus 100 for detecting a switch position. The apparatus 100 has a first circuit node 10 and a second circuit node 20 by means of which an electric motor 95 (for example an electrical tool) can be connected to an AC electric voltage $U_N$. In this case, an electronic semiconductor 90 (for example a triac) can be used in order to appropriately drive the motor 95. The AC voltage is designed to be, for example, sinusoidal with a defined rms value, for example at the level of 230 V. A manually actuable switch 40 is connected between the first circuit node 10 and a third circuit node 30, by means of which switch the electric motor 95 can be switched on and off.

The switch 40 thus represents a power switch via which the entire supply current of the motor 95 can flow in the closed state. By way of example, the switch 40 is designed as an electromechanical switch but it can alternatively also be designed as a power-electronic switch. Functionally, the switch 40 thus effects a line interruption in the current supply between the first circuit node 10 and a switched-mode power supply device 60 for a microcomputer device 80. The microcomputer device 80 (for example a microcontroller) is provided to control functionalities (for example tacho-circuit for acquiring speeds, restart protection, potentiometer, etc.) of the motor 95 and various peripheral elements of the motor 95.

A resistor 50 is connected between the first circuit node 10 and the third circuit node 30, by means of which resistor the switch 40 can be bridged. In this way, the microcomputer device 80 can be permanently supplied with electric current, with the result that the microcomputer device 80 executes programs as soon as the electric voltage $U_N$ is switched on. A size of the resistor 50 is dimensioned such that, in the switched-off state of the motor 95, a safe current, which is not greater than approximately 10 mA, flows. In this way, the branch with the resistor 50 forms a stand-by circuit via which the microcomputer device 80 is permanently electrically supplied.

By means of the switched-mode power supply device 60, an electric supply voltage $V_{CC}$ can be provided for the microcomputer device 80. The switched-mode power supply device 60 comprises a Zener diode 61 the cathode of which is connected to the third circuit node 30 and which is connected in parallel with a capacitor 62 (for example an electrolytic capacitor). One of the connections of the capacitor 62 is connected to the third circuit node 30; the second connection of the capacitor 20 is connected to a resistor 64, wherein the resistor 64 in turn is connected to an anode of a diode 45. The resistor 64, the anode of the Zener diode 61 and a connection of the capacitor 62 are connected to one another at a circuit node 63, which is at ground potential. The cathode of the diode 65 is connected to the second circuit node 20. The diode 65 is used to charge the capacitor 62 only ever with a defined half-cycle of the supply voltage $U_N$. As a result, the capacitor 62 charges up during operation via the resistor 50 and the Zener diode 61 and provides the supply voltage $V_{CC}$.

Owing to the fact that the switching-on and switching-off of the switch 40 effects a change in the supply voltage $V_{CC}$, a detection voltage $U_D$ is acquired between the supply voltage $V_{CC}$ or the third circuit node 30 and the second circuit node 20 and used for the analysis of the circuit state of the switch 40.

In FIG. 1, a calculation device 70 which is connected to the microcomputer device 80 and is used to digitize the mains voltage $U_N$ is visible. The calculation device 70 is provided, in particular, to perform phase gating control for the motor 95. The calculation device 70 is illustrated in a highly simplified manner and can in practice comprise transistor stages and/or filter stages (not illustrated) which convert the supplied signal into a value which the microcomputer device 80 can detect. It is calculated by means of the calculation device 70 which half-cycle of the supply voltage $U_N$ is presently active. In addition, a period of the respective half-cycle can be calculated. By means of timer devices (not illustrated) of the microcomputer device 80, it is possible to calculate which period a half-cycle has. This information is important because said times are used for the phase gating controllers of a triac (not illustrated) for driving the motor 95.

Owing to the fact that the state of the switch 40 is therefore reflected in said detection voltage $U_D$, it is advantageously possible for the switch position to be concluded from an evaluation of the detection voltage $U_D$. The specific technical configuration of the calculation device 70 depends on the microcomputer device 80 used in each case.

Figure 2:
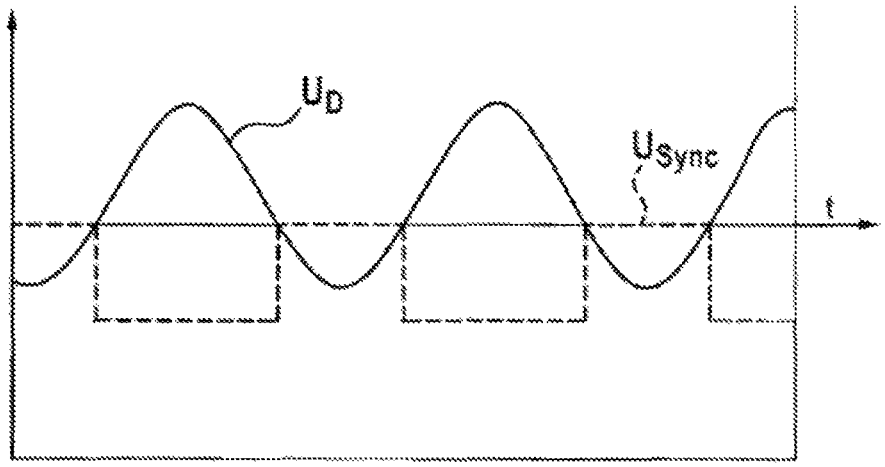
FIG. 2 shows a temporal signal profile of a voltage, which is evaluated in order to detect the switch position, when the switch is switched off.

FIG. 2 shows a temporal graph of profiles of the detection voltage $U_D$ and a synchronization signal $U_{Sync}$ in the event of an open switch 40. It can be seen that the synchronization signal $U_{Sync}$ is formed asymmetrically with respect to the time axis because the detection voltage $U_D$ has an asymmetrical profile with respect to the zero line. The negative half-cycle of the detection voltage $U_D$ has a markedly smaller amplitude than the positive half-cycle of the detection voltage $U_D$. This is the case if the switch 40 is in the "OFF" position.

Figure 3:
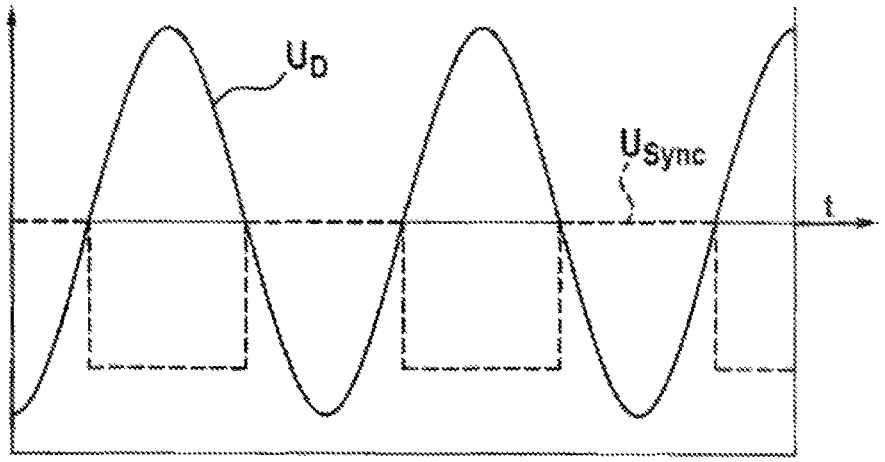

In contrast thereto, FIG. 3 shows a situation in which the switch 40 is switched on. It can be seen that a voltage level of the electric detection voltage $U_D$ is somewhat higher and symmetrical with respect to the zero line or time axis, wherein, as a result of this, the signal shape of the signal $U_{Sync}$ is also formed in a symmetrical manner with respect to the time axis.

The changes in the synchronization signal $U_{Sync}$ are effected by the resistor 50 which is connected between the first circuit node 10 and the third circuit node 30. As a result, an additional electric voltage can drop across the resistor 50 in the switched-off state in comparison to the switched-on state. As a result of this, it can be calculated by means of the synchronization signal $U_{Sync}$ how the positive half-cycle is formed in relation to the negative half-cycle of the detection voltage $U_D$. From this relationship, it can be calculated whether the switch 40 is open or closed.

Figure 4:
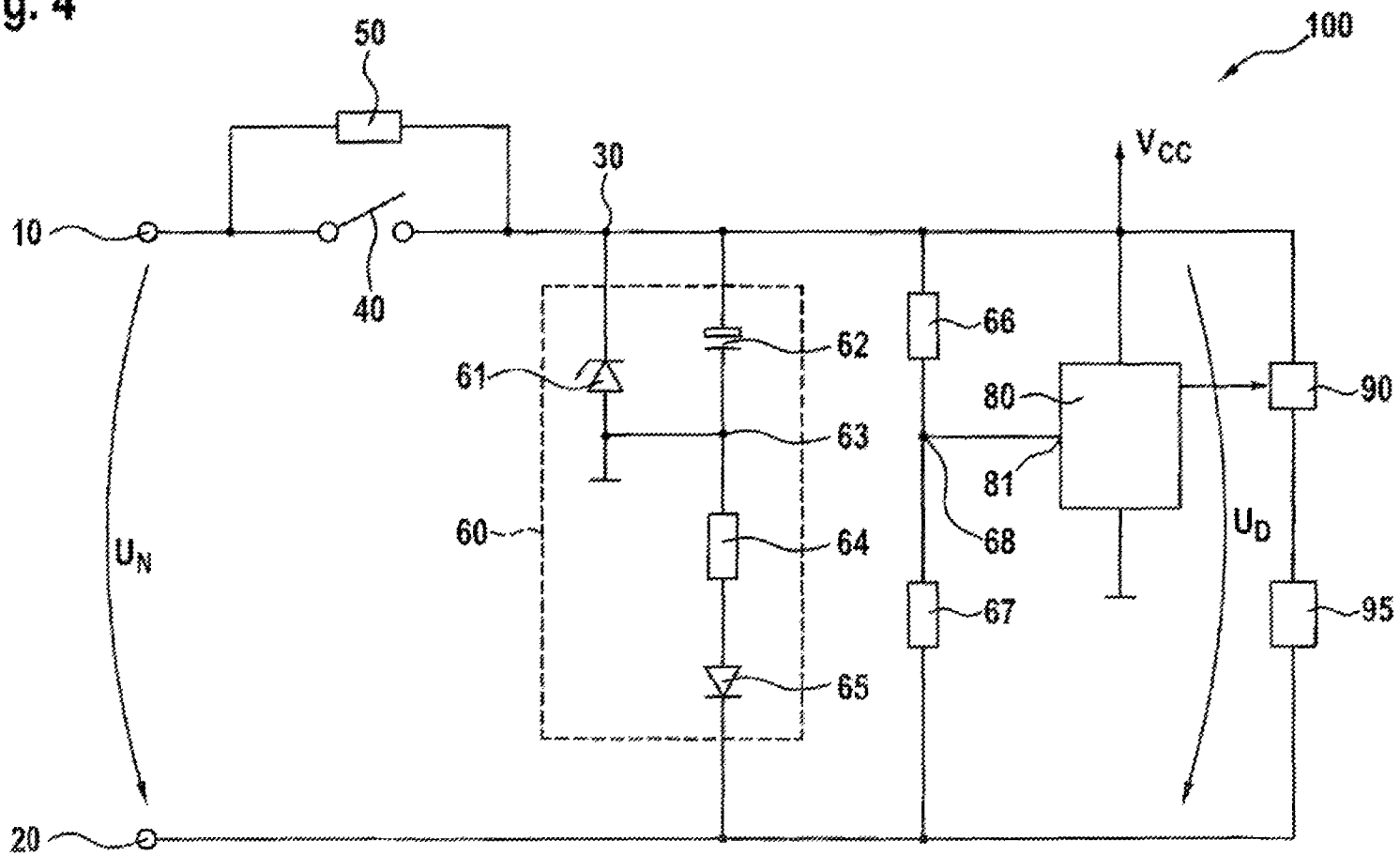
FIG. 4 shows a second embodiment of the apparatus according to the disclosure.

FIG. 4 shows another embodiment of an apparatus 100 for detecting a switch position. This embodiment differs from that of FIG. 1 in that no calculation device 70 is provided and in that an electrical voltage divider with resistors 66, 67 which are connected to a circuit node 68 is provided between the third circuit node 30 and the second circuit node 20, wherein the circuit node 68 is routed to an input 81 of the microcomputer device. The input 81 can be directed to an analog-to-digital converter or to a comparator of the microcomputer device 80. In this case, the fact that the level of the supply voltage $V_{CC}$ for the microcomputer device 80 also changes owing to the changing of the switch position of the switch 40 is used. This is acquired via the electric voltage at the circuit node 68 and supplied to the microcomputer device 80.

At defined instants, the voltage value which is present at the input 81 of the microcomputer device 80 is calculated by means of the voltage divider 66, 67. Owing to the different voltage profiles of the detection voltage $U_D$, it is thus possible to unambiguously detect the position of the switch 40.

The defined instants are preferably in the center of each negative half-cycle of the detection voltage $U_D$, wherein the value of the voltage drop across the resistor 66 or across the resistor 67 is calculated each time.

The microcomputer device 80 can measure said voltage using an analog-to-digital converter or a comparator and thus determine whether the switch 40 is switched off or on. Most microcontrollers have an analog-to-digital converter and/or a comparator as standard.

Advantageously, each of the aforesaid variants is possible as a redundant solution of a solution which is already known for detecting a switch position. This is particularly important in the case of electrical devices which require restart protection. In the case of redundant solutions, the solution according to the disclosure can be used as one of the channels.

In the case of non-redundant solutions, that is to say if only a single channel is required for switch detection, the solution according to the disclosure is advantageously substantially less expensive than known solutions. This is due to the fact that an additional circuit is dispensed with, as a result of which space is created on a circuit board.

All of the described variants advantageously also function in the case of double-pole switches with stand-by line, wherein the switch 40 can in this case (not illustrated) also be provided in the supply line from the second circuit node 20 to the microcomputer device 80.

What is particularly advantageous is that the solution according to the disclosure is very inexpensive to create. In practice, this merely means implementing a few lines of additional program code.

Figure 5:
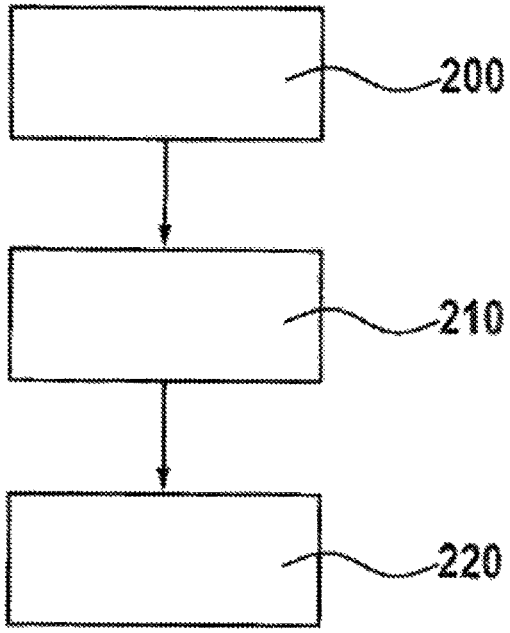
FIG. 5 shows a basic sequence of an embodiment of the method according to the disclosure.

FIG. 5 shows a basic sequence of an embodiment of the method according to the disclosure.

In a first step 200, an electric supply voltage $U_N$ is provided at a first circuit node 10 and a second circuit node 20, wherein the voltage $U_N$ can be switched on and off by means of a switch 40, wherein the switch 40 is bridged by a resistor 50.

In a second step 210, a supply voltage $V_{CC}$ is provided for a microcomputer device 80 by means of a switched-mode power supply device 60.

In a third step 220, an electric detection voltage $U_D$ between a second circuit node 20 of a voltage supply $U_N$ and a voltage supply $V_{CC}$ of a microcomputer device 80 is evaluated, wherein the position of the switch 40 is concluded from the analysis.

In summary, the present disclosure provides an apparatus and a method for detecting a switch position of an electric machine. The switch position is detected using simple means, which is particularly important for various standardized specifications of electric machines.

Although the disclosure has been described above on the basis of specific exemplary embodiments, it is not in any way limited thereto. A person skilled in the art would thus modify the above-described features or combine them with one another in a suitable manner without deviating from the core of the disclosure.

What is claimed is:

1. An apparatus for detecting a configuration of a switch comprising:

a first circuit node and a second circuit node configured to connect the apparatus to an AC electric voltage;

a switch connected between the first circuit node and a third circuit node;

a resistor connected between the first circuit node and the third circuit node in parallel with the switch;

a calculation device connected between the second circuit node and a microcomputer device, the calculation device further comprising at least one transistor or filter stage configured to generate digitized values of the AC electric voltage for detection by the microcomputer device; and the microcomputer device operatively connected to the calculation device and configured to identify the configuration of the switch, the microcomputer device being operatively configured to:

measure a first amplitude of a positive half-cycle of the AC electric voltage during at least one full cycle of the AC electric voltage based on the digitized values generated by the calculation device;

measure a second amplitude of a negative half-cycle of the AC electric voltage during the at least one full cycle of the AC electric voltage based on the digitized values generated by the calculation device;

detect that the switch is open in response to an asymmetry between the first amplitude and the second amplitude of the AC electric voltage; and detect that the switch is closed in response to a symmetry between the first amplitude and the second amplitude of the AC electric voltage.

2. A method for detecting a configuration of a switch, comprising:

supplying an AC electric voltage to a first circuit node and a second circuit node, the AC electric voltage configured to be switched on and off by the switch that is connected between the first circuit node and a third circuit node, the first circuit node and the third circuit node being bridged by a resistor connected in parallel to the switch;

measuring, with a microcomputer device, a first amplitude of a positive half-cycle of the AC electric voltage during at least one full cycle of the AC electric voltage using at least one of an analog-to-digital converter or a comparator of the microcomputer device to generate measurements of the AC electric voltage between the second circuit node and the third circuit node;

measuring, with the microcomputer device, a second amplitude of a negative half-cycle of the AC electric voltage during the at least one full cycle of the AC electric voltage using the at least one of the analog-to-digital converter or the comparator of the microcomputer device;

detecting, with the microcomputer device, that the switch is open in response to an asymmetry between the first amplitude and the second amplitude of the AC electric voltage; and detecting, with the microcomputer device, that the switch is closed in response to a symmetry between the first amplitude and the second amplitude of the AC electric voltage.

3. The apparatus of claim 1 further comprising:

a semiconductor device connected to the third circuit node and configured to be connected to a motor; and the microcomputer device being operatively connected to the semiconductor device, the microcomputer device being further configured to:

provide restart protection to control application of the AC electric voltage to the motor through the semiconductor device based on the detection of the switch being open or closed.

4. The apparatus of claim 3 wherein the semiconductor device is a triac.

5. The method of claim 2 further comprising:

providing, with the microcomputer device, restart protection to control application of the AC electric voltage to the motor through a semiconductor device that is connected to the third circuit node and to a motor based on the detection of the switch being open or closed.

6. The method of claim 5 wherein the microcomputer device operates a triac to enable the AC electric voltage to be applied to the motor through the semiconductor device.

7. The method of claim 2 further comprising:

measuring, with the microcomputer device, the first amplitude of the positive half-cycle of the AC electric voltage during the at least one full cycle of the AC electric voltage using the least one of the analog-to-digital converter or the comparator of the microcomputer device that is routed to a voltage divider connected between the second circuit node and the third circuit node; and measuring, with the microcomputer device, the second amplitude of the negative half-cycle of the AC electric voltage during the at least one full cycle of the AC electric voltage using the least one of the analog-to-digital converter or the comparator of the microcomputer device that is routed to the voltage divider connected between the second circuit node and the third circuit node.

8. The apparatus of claim 1 wherein the switch is a manually actuable switch and the microcomputer device is not configured to control operation of the switch.

* * * * *